US009958826B2

(12) United States Patent
Mizuno et al.

(10) Patent No.: US 9,958,826 B2
(45) Date of Patent: May 1, 2018

(54) DRIVE SOURCE SUPPORT CONFIGURATION FOR AN IMAGE FORMING APPARATUS

(71) Applicant: Brother Kogyo Kabushiki Kaisha, Nagoya-shi, Aichi-ken (JP)

(72) Inventors: Tomoyuki Mizuno, Nagoya (JP); Tomitake Aratachi, Toyokawa (JP); Tomonori Watanabe, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 14/529,300

(22) Filed: Oct. 31, 2014

(65) Prior Publication Data

US 2015/0117898 A1 Apr. 30, 2015

(30) Foreign Application Priority Data

Oct. 31, 2013 (JP) ..... 2013-226755

(51) Int. Cl.

| | |
|---|---|
| ***G03G 15/00*** | (2006.01) |
| ***G03G 15/01*** | (2006.01) |
| ***G03G 21/16*** | (2006.01) |
| ***G03G 21/18*** | (2006.01) |

(52) U.S. Cl.

CPC ..... *G03G 21/1857* (2013.01); *G03G 21/1619* (2013.01); *G03G 15/0142* (2013.01); *G03G 15/757* (2013.01); *G03G 15/80* (2013.01); *G03G 21/1652* (2013.01); *G03G 21/186* (2013.01)

(58) Field of Classification Search

CPC .. G03G 15/0142; G03G 15/80; G03G 15/757; G03G 21/1619; G03G 21/1647; G03G 21/1652; G03G 21/1857; G03G 21/186; G03G 2215/00978

See application file for complete search history.

(56) References Cited

U.S. PATENT DOCUMENTS

| | | | | |
|---|---|---|---|---|
| 2011/0072727 | A1* | 3/2011 | Kumazawa | G03G 15/605 49/358 |
| 2012/0051788 | A1* | 3/2012 | Tsuji | G03G 15/757 399/167 |
| 2013/0108342 | A1* | 5/2013 | Maekawa | G03G 21/1619 399/361 |

FOREIGN PATENT DOCUMENTS

| | | |
|---|---|---|
| JP | H07-325536 A | 12/1995 |
| JP | 2005-031447 A | 2/2005 |

OTHER PUBLICATIONS

Nov. 22, 2016—(JP) Notice of Reasons for Rejection—App 2013-226755.

* cited by examiner

*Primary Examiner* — Joseph S Wong

(74) *Attorney, Agent, or Firm* — Banner & Witcoff, Ltd.

(57) ABSTRACT

An image forming apparatus includes a casing having a frame, a drive source configured to generate a driving force, a gear mechanism configured to receive the driving force of the drive source, and a drive source support formed in the frame. The drive source support encloses and supports the drive source. At least an upper portion of the drive source support has a plurality of first openings which are spaced from each other.

13 Claims, 6 Drawing Sheets

DRIVE SOURCE SUPPORT CONFIGURATION FOR AN IMAGE FORMING APPARATUS

CROSS-REFERENCE TO RELATED APPLICATION

This application claims priority from Japanese Patent Application No. 2013-226755, filed on Oct. 31, 2013, which is incorporated herein by reference in its entirety.

TECHNICAL FIELD

Aspects disclosed herein relate to an electrophotographic image forming apparatus.

BACKGROUND

A known electgrophotographic image forming apparatus comprises a frame and a gear unit attached to the frame. A motor and gears are rotatably attached to the frame. The gears are configured to transmit a driving force of the motor to a photosensitive drum.

SUMMARY

Aspects of the disclosure provide an image forming apparatus comprising a casing including a frame, a drive source configured to rotate about the axis to generate a driving force, a gear mechanism configured to receive the driving force of the drive source, and a drive source support which is formed in the frame and encloses and supports the drive source. At least an upper portion of the drive source support has a plurality of first openings which are spaced from each other.

According to one more aspects of the disclosure, an image forming apparatus may allow discharge of heat generated by the drive source and prevent a user from touching the drive source.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Embodiments according to one or more aspects will be described below with reference to the accompanying drawings. The embodiments described below are merely examples. Various changes, arrangements and modifications may be applied therein without departing from the spirit and scope of the disclosure.

1. Overall Structure of Printer

Figure 1:
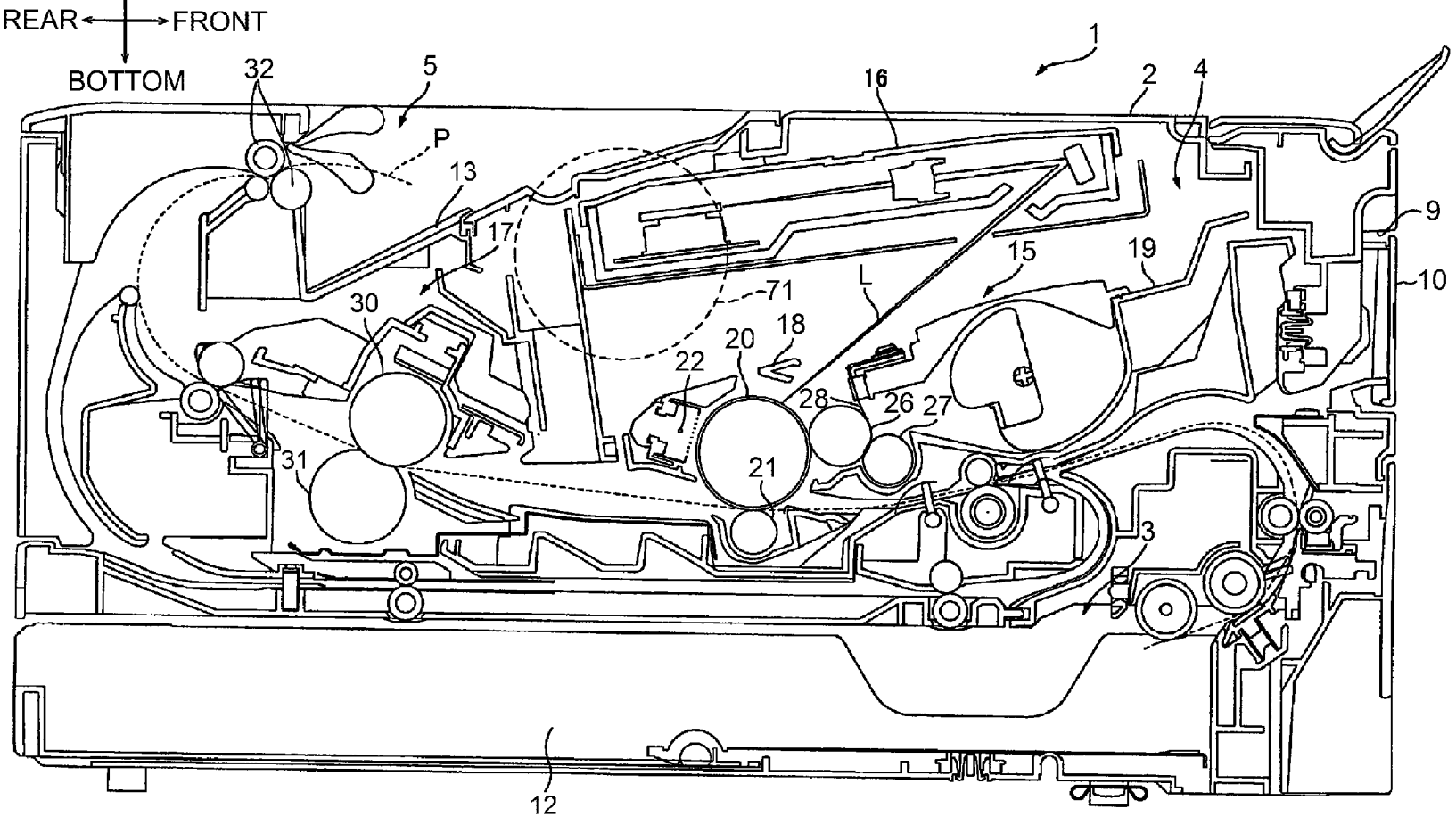
FIG. 1 is a side cross-sectional view of a printer, as an example of an image forming apparatus, according to one or more aspects of the disclosure.

As shown in FIG. 1, a printer 1, as an example of an image forming apparatus, is an electrophotographic monochrome printer. The printer 1 includes a main casing 2, which is an example of a casing, a sheet feeder 3, an image forming unit 4, and a sheet discharge unit 5.

The main casing 2 is generally box-shaped and accommodates therein the sheet feeder 3, the image forming unit 4, and the sheet discharge unit 5.

In the following description, directional terms are used to define the various parts when the printer 1 is disposed in a horizontal plane. The top and the bottom in the sheet of FIG. 1 may be defined as the top and the bottom of the printer 1, respectively. The left-right direction of the printer 1 may be determined when the printer 1 is viewed from the front. The front or near side and the back side of the sheet of FIG. 1 may be defined as the left and the right of the printer 1, respectively. More specifically, the front, rear, left, right, top, and bottom of the printer 1 may be identified as indicated by the arrows in each of the drawings.

The main casing 2 includes a cartridge opening 9 and a front cover 10.

The cartridge opening 9 is defined at the front end of the main casing 2 so as to penetrate a front wall of the main casing 2 in the front-rear direction. The front cover 10 is supported at the front wall of the main casing 2 so as to pivot about a lower end of the front cover 10. The front cover 10 opens and closes the cartridge opening 9.

The sheet feeder 3 is disposed at the bottom in the main casing 2 and is configured to feed a sheet P to the image forming unit 4.

The sheet feeder 3 includes a feed tray 12 which is detachably attached to the main casing 2. The feed tray 12 is shaped like a box open upward and accommodates a plurality of sheets P therein.

The image forming unit 4 is configured to form an image on a sheet P. The image forming unit 4 is disposed in the main casing 2, at a position above the sheet feeder 3. The image forming unit 4 includes a process cartridge 15, a scanner unit 16, and a fixing unit 17.

The process cartridge 15 is detachably attached to the main casing 2 through the cartridge opening 9. The process cartridge 15, when attached to the main casing 2, is positioned generally in the vertically middle of the main casing 2.

The process cartridge 15 includes a drum cartridge 18 and a developing cartridge 19.

The drum cartridge 18 includes a photosensitive drum 20, a transfer roller 21, and a scorotron charger 22.

Figure 3:
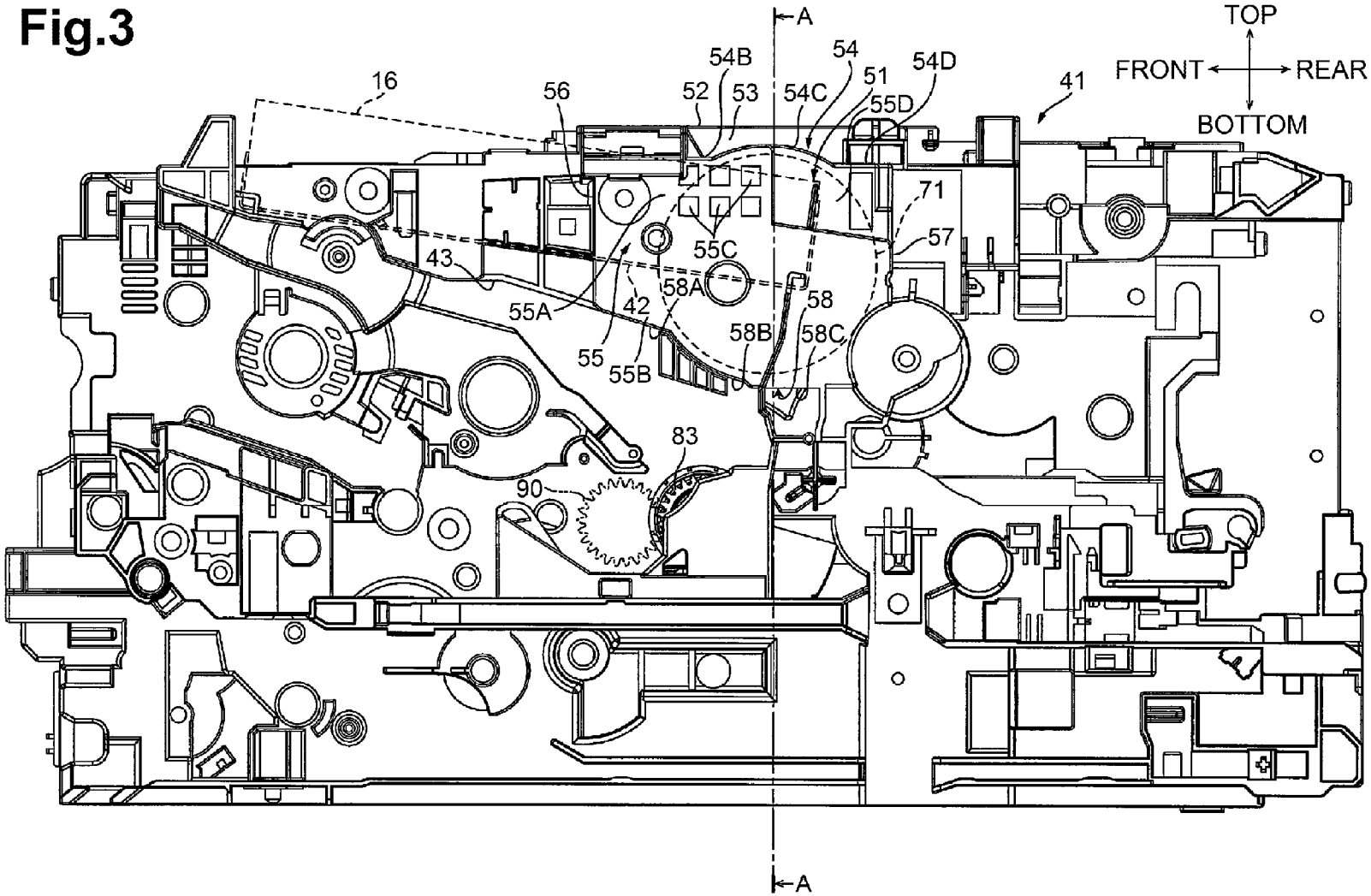
FIG. 3 is a side view of the frame of the printer shown in FIG. 1, as viewed from the right of the printer.

The photosensitive drum 20 is disposed at a rear end of the drum cartridge 18. A drum gear 90, which is shown by an imaginary line (one-dot-one-dash line) in FIG. 3, is disposed at an end of the photosensitive drum 20 so that the drum gear 90 and the photosensitive drum 20 do not rotate relative to each other.

As shown in FIG. 1, the transfer roller 21 is disposed below the photosensitive drum 20. An upper surface of the transfer roller 21 is in contact with a lower surface of the photosensitive drum 20.

The scorotron charger 22 is disposed to the rear of and partially above the photosensitive drum 20 while leaving a small clearance to the photosensitive drum 20.

The developing cartridge 19 is detachably attached to the drum cartridge 18. The developing cartridge 19, when attached to the drum cartridge 18, is positioned to the front of and partially above the photosensitive drum 20.

The developing cartridge 19 includes a developing roller 26, a supply roller 27, and a blade 28 for regulating a toner layer thickness. The developing cartridge 19 stores toner therein.

The developing roller 26 is disposed at a rear end of the developing cartridge 19 and an upper rear portion of the developing roller 26 is exposed from the developing cartridge 19. A rear surface of the developing roller 26 is in contact with a front surface of the photosensitive drum 20.

The supply roller 27 is disposed to the front of and partially below the developing roller 26. The upper rear surface of the supply roller 27 is in press-contact with a lower front surface of the developing roller 26.

The blade 28 is disposed to the front of and partially above the developing roller 26. The blade 28 is shaped like a plate extending vertically in side view of the printer 1. A lower end of the blade 28 is in contact with an upper front surface of the developing roller 26.

The scanner unit 16 is disposed in the main casing 2 at a position above the process cartridge 15. The scanner unit 16 emits a laser beam L based on image data toward the photosensitive drum 20 to irradiate a peripheral surface of the photosensitive drum 20.

The fixing unit 17 is disposed in the main casing 2 at a position to the rear of and spaced from the process cartridge 15.

The fixing unit 17 includes a heat roller 30 and a pressure roller 31 which is in contact with a lower rear surface of the heat roller 30.

The sheet discharge unit 5 is disposed to the rear of and above the fixing unit 17. The sheet discharge unit 5 includes a discharge tray 13 and a pair of discharge rollers 32.

The discharge tray 13 is disposed at a rear portion of an upper wall of the main casing 2. The discharge tray 13 is recessed downward form an upper surface of the main casing 2 so as to receive the sheet P.

The discharge rollers 32 are disposed in the main casing 2 at a position to the rear of and above the discharge tray 13 while leaving a space to the discharge tray 13. A lower front surface of one of the discharge rollers 32 is in contact with an upper rear surface of the other discharge roller 32.

When the printer 1 is controlled by a controller (not shown) to start image forming, the scorotron charger 22 uniformly charges a surface of the photosensitive drum 20. The scanner unit 16 irradiates the surface of the photosensitive drum 20 based on image data, thereby forming an electrostatic latent image on the surface of the photosensitive drum 20.

The supply roller 27 supplies toner to the developing roller 26. The toner is positively charged frictionally between the developing roller 26 and the supply roller 27, and is carried on the developing roller 26. The blade 28 regulates the toner carried on the developing roller 26 to a uniform thickness. The developing roller 26 supplies the toner having the uniform thickness to the electrostatic latent image on the photosensitive drum 20. Consequently, a toner image is formed on the surface of the photosensitive drum 20.

The sheet P is fed from the feed tray 12 one at a time at a predetermined timing as various rollers rotate, such that the photosensitive drum 20 and the transfer roller 21 nip the sheet P therebetween. The toner image on the photosensitive drum 20 is transferred to the sheet P when the sheet passes between the photosensitive drum 20 and the transfer roller 21.

Thereafter, the sheet P passes through the fixing unit 17 and is conveyed toward the discharge rollers 32. The heat roller 30 and the pressure roller 31 heats and presses the sheet P when the sheet passes therebetween, thereby thermally fixing the toner image on the sheet P. The discharge rollers 32 discharge the sheet P onto the discharge tray 13 in a rear-to-front direction.

As described above, during image forming in the printer 1, the sheet P is conveyed along a generally S-shaped path from the feed tray 12 to the discharge tray 13.

2. Detailed Structure of Main Casing

Figure 2:
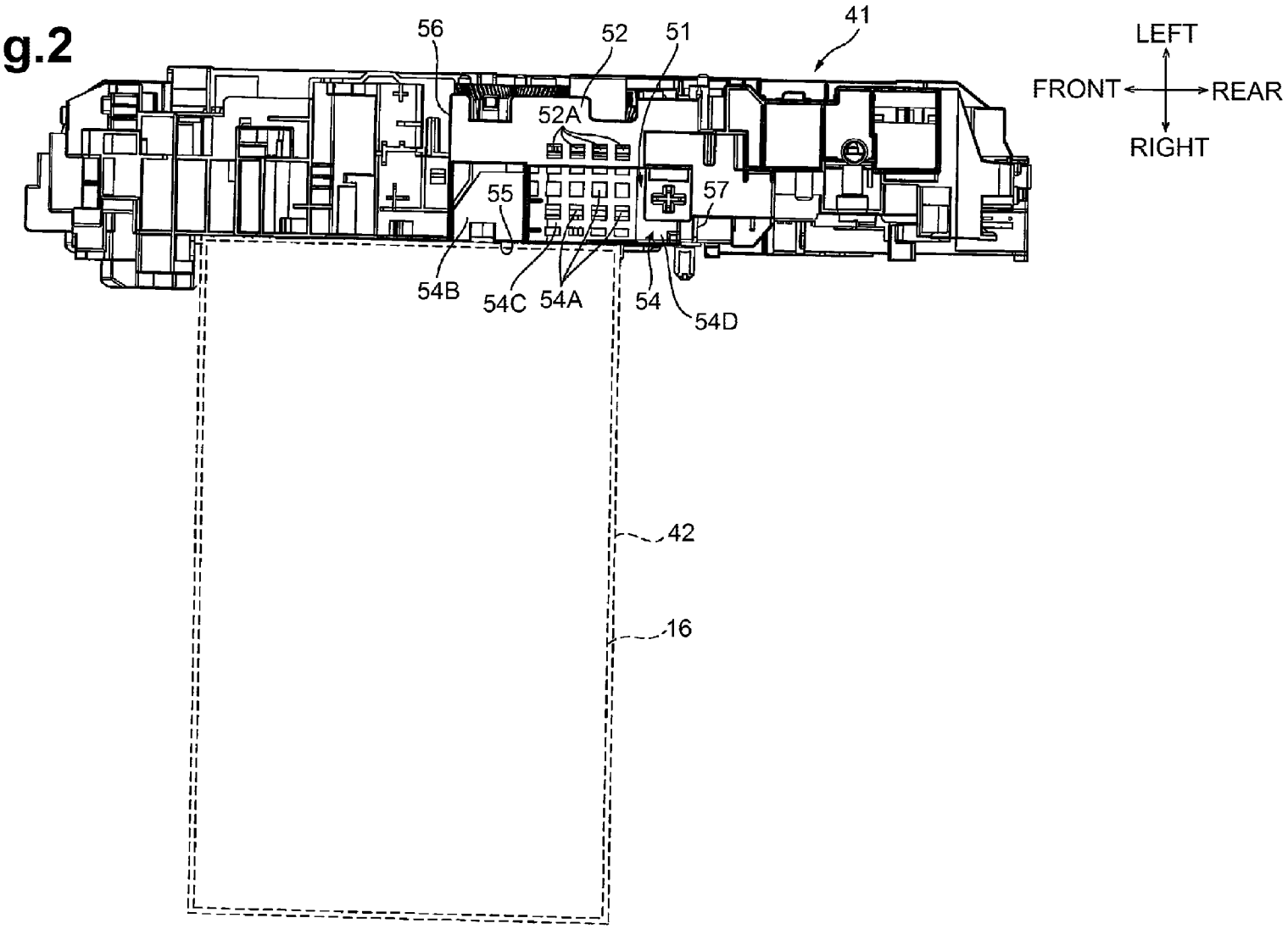
FIG. 2 is a plan view of a frame of the printer shown in FIG. 1.
Figure 4:
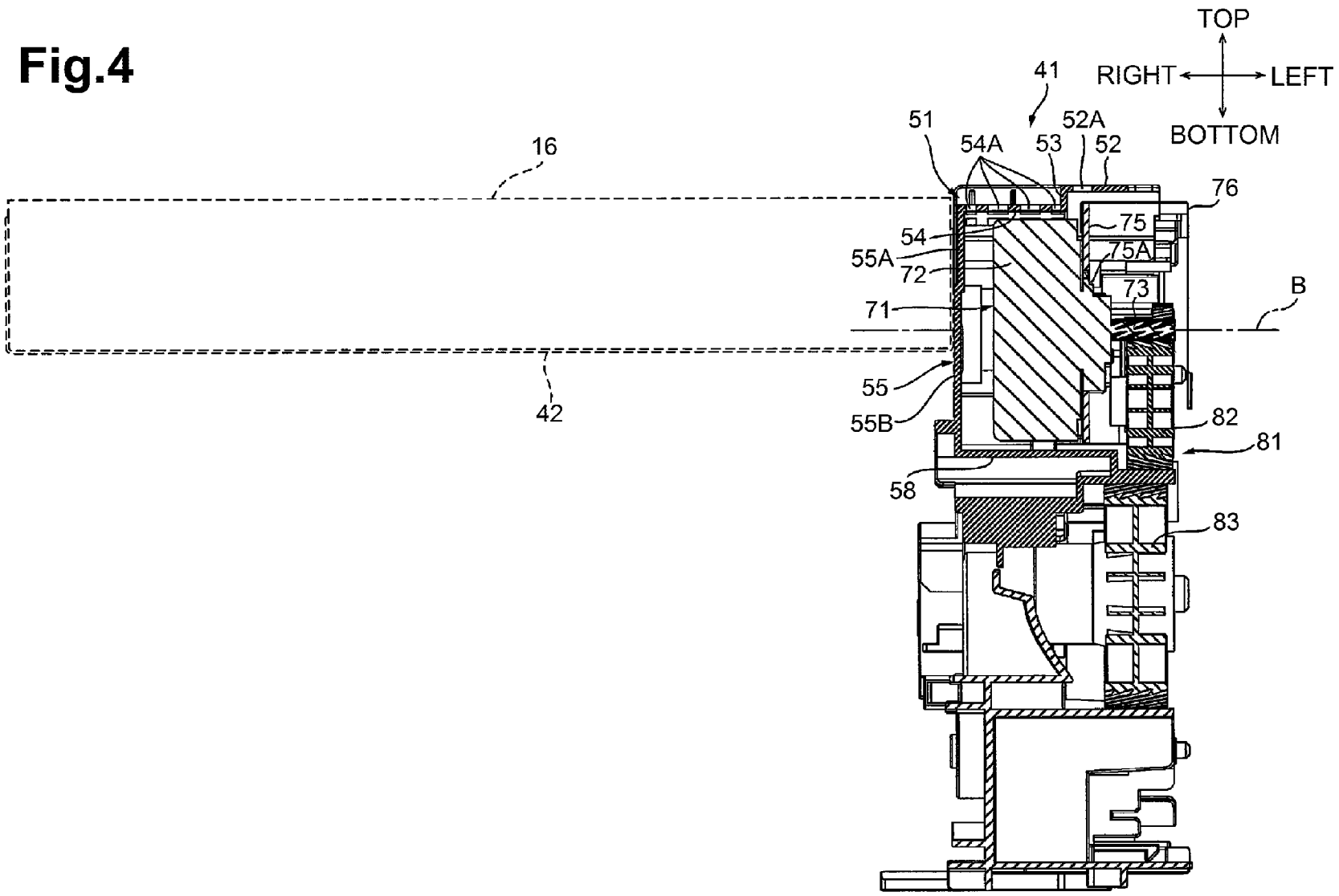
FIG. 4 is a cross-sectional view of the frame taken along A-A in FIG. 3.

As shown in FIGS. 2, 3, and 4, the main casing 2 includes a frame 41.

(1) Frame

The frame 41 has a generally rectangular shape in side view of the printer 1. The frame 41 is paired up with a frame (not shown), and the frame 41 and the other frame are spaced from each other in the left-right direction. The frame 41 is disposed on the left side of the printer 1. A scanner support 42 extends between the frame 41 and the other frame on the right side.

The scanner support 42 is shaped like a rectangular frame having a bottom in plan view of the printer 1, and is disposed at an upper end portion of a front side of the frame 41 in side view of the printer 1. The scanner support 42 is inclined slightly downward in a front-to-rear direction. The scanner support 42 supports the scanner unit 16.

The frame 41 includes a recessed portion 43, a motor support 51 which is an example of a drive source support, and a gear mechanism 81.

(2) Recessed Portion

Figure 5:
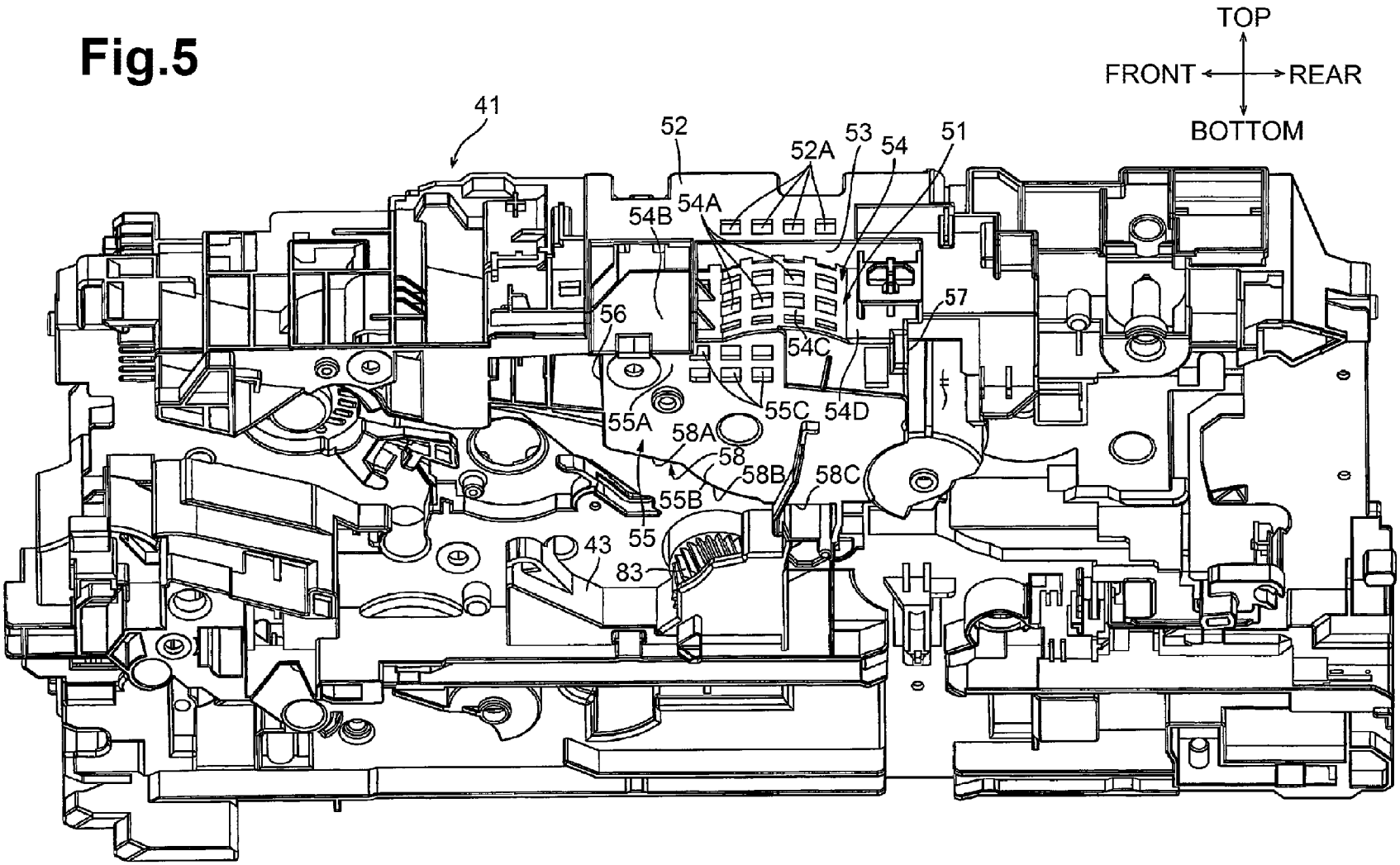
FIG. 5 is a perspective view of the frame of the printer shown in FIG. 1, as viewed from the top right of the printer.

As shown in FIGS. 3 and 5, the recessed portion 43 is defined in a front portion of the frame 41, and generally in the vertically middle of the frame 41. The recessed portion 43 has a generally C shape open frontward in side view of the printer 1 and is recessed leftward from a right surface of the frame 41. The recessed portion 43 is positioned below the scanner unit 16 and the scanner support 42 in side view of the printer 1. The recessed portion 43 guides and receives the process cartridge 15. When the process cartridge is attached to the main casing 2, a left end portion of the process cartridge 15 is engaged in the recessed portion 43.

(3) Motor Support

As shown in FIGS. 3, 4, and 5, the motor support 51 is formed at an upper portion of the frame 41 and in the middle of the frame 41 in the front-rear direction. A first wall 52 and a second wall 53 are positioned above the motor support 51.

The first wall 52 is formed at an upper end of the frame 41 and extends rightward from a middle portion of the frame 41 in the front-rear direction. The first wall 52 has a flat, generally rectangular plate shape in plan view of the printer 1 and extends in the front-rear direction. The first wall 52 has a plurality of upper openings 52A which are an example of a plurality of second openings.

The upper openings 52A are positioned at a middle portion of the first wall 52 in the front-rear direction and at a right end portion of the first wall 52, and penetrate the first wall 52 vertically. Each of the upper openings 52A has a generally rectangular shape in plan view of the printer 1. The upper openings 52A are spaced from each other in the front-rear direction.

A second wall 53 extends downward from a right end of the first wall 52. The second wall 53 has a flat, generally rectangular plate shape in side view of the printer 1 and extends in the front-rear direction.

The motor support 51 is shaped generally like a cylinder with its right end closed, and includes an upper wall 54, a right wall 55, a front wall 56, a rear wall 57, and a lower wall 58. The right wall 55 is an example of a side wall.

The upper wall 54 extends rightward from a lower end portion of the second wall 53. The upper wall 54 extends generally in the front-rear direction. The upper wall 54 includes an upper front portion 54B, an upper arcuate portion 54C, and an upper rear portion 54D.

The upper front portion 54B is positioned at a front portion of the upper wall 54. The upper front portion 54B has a flat, generally rectangular plate shape in plan view of the printer 1 and extends in the front-rear direction.

The upper arcuate portion 54C is shaped like a plate generally rectangular in plan view and upwardly arcuate in side view of the printer 1, and extends rearward from a rear end of the upper front portion 54B. The radius of curvature of the upper arcuate portion 54C is generally equal to that of a motor body 72, which will be described later. The upper arcuate portion 54C has a plurality of intermediate openings 54 which are an example of a plurality of first openings. The upper arcuate portion 54C is an example of an upper portion and an example of a first surface.

The intermediate openings 54A are provided generally all over the upper arcuate portion 54C and penetrate the upper arcuate portion 54C vertically. Each of the intermediate openings 54A has a generally rectangular shape in plan view of the printer 1. The intermediate openings 54A are arranged in a spaced manner from each other in the front-rear direction and in the left-right direction.

The upper rear portion 54D has a flat, generally rectangular plate shape in plan view of the printer 1 and extends rearward from a rear end of the upper arcuate portion 54C.

The right wall 55 extends downward from a right end portion of the upper wall 54. The right wall 55 has a flat, generally rectangular plate shape in side view of the printer 1. The right wall 55 includes an upper right portion 55A and a lower right portion 55B. The upper right portion 55A and the lower right portion 55B are linear in section. The upper right portion 55A includes a stepped portion 55D and a plurality of right openings 55C which are also an example of a plurality of first openings. The upper right portion 55A is an example of an upper portion and an example of a second surface.

The stepped portion 55D is positioned to the rear of the upper right portion 55A. The stepped portion 55D is slightly recessed leftward from a right surface of the upper right portion 55A.

The right openings 55C are positioned in the middle of the upper right portion 55A and penetrates the upper right portion 55A in the left-right direction. Each of the right openings 55C has a generally rectangular shape in side view of the printer 1. The right openings 55C are arranged in a spaced manner from each other in the front-rear direction and vertically. The right openings 55C are positioned to the front of the stepped portion 55D.

The front wall 56 extends across a front end portion of the right wall 55, a front end portion of the upper wall 54, a front end portion of the second wall 53, and a front end portion of the first wall 52. The front wall 56 has a flat, generally rectangular plate shape in front view of the printer 1 and extends vertically.

The rear wall 57 extends across a rear end portion of the right wall 55, a rear end portion of the upper wall 54, a rear end portion of the second wall 53, and a rear end portion of the first wall 52. The rear wall 57 has a flat, generally rectangular plate shape in front view of the printer 1 and extends vertically. A lower portion of the rear wall 57 is curved frontward.

The lower wall 58 extends across a lower end of the front wall 56, a lower end of the rear wall 57, and a lower end of the right wall 55. The lower wall 58 extends generally in the front-rear direction. The lower wall 58 includes a lower front portion 58A, a lower arcuate portion 58B, and a lower rear portion 58C.

The lower front portion 58A is positioned at a front portion of the lower wall 58. The lower front portion 58A has a flat, generally rectangular plate shape in plan view of the printer 1 and extends rearward while being inclined slightly downward.

The lower arcuate portion 58B is shaped like a plate generally rectangular in plan view and downwardly arcuate in side view of the printer 1, and extends rearward and downward from a rear end of the lower front portion 58A. The radius of curvature of the lower arcuate portion 58B is generally equal to that of the motor body 72, which will be described later.

The lower rear portion 58C has a flat, generally rectangular plate shape in plan view of the printer 1 and extends rearward from a rear end of the lower arcuate portion 58B.

The lower wall 58, the lower right portion 55B, the front wall 56, and the rear wall 57, which are an example of a cover portion, cover a motor 71, which will be described later. Specifically, the lower wall 58, the lower right portion 55B, the front wall 56, and the rear wall 57 cover a lower surface, lower right surface, a front surface, and a rear surface of the motor 71 continuously without a clearance.

The motor support 51 supports the motor 71 in a space enclosed by the first wall 52, the second wall 53, the upper wall 54, the right wall 55, the front wall 56, the rear wall 57, and the lower wall 58. The motor 71 is an example of a drive source.

(4) Motor

The motor 71 is disposed in the motor support 51. The motor 71 includes the motor body 72 and a motor shaft 73.

The motor body 72 is shaped like a cylinder extending in the left-right direction. A middle portion of the motor body 72 extends leftward. An upper end of the motor body 72 is in proximity to a lower surface of the upper arcuate portion 54C of the upper wall 54. In other words, the upper wall 54 covers an upper portion of the motor body 72. A lower end of the motor body 72 is in proximity to an upper surface of the lower arcuate portion 58B of the lower wall 58. In other words, the lower wall 58 covers a lower portion of the motor body 72. A right end of the motor body 72 is spaced from a left surface of the front wall 56. A left end of the motor body 72 is aligned, in the left-right direction, with a right end of the first wall 52 and a left end of the lower wall 58. The motor body 72 is mounted on a motor board 75, which is an example of a drive board.

The motor board 75 has a generally rectangular plate shape in side view of the printer 1 and has a through-hole 75A formed at a middle portion thereof. The motor board 75 is attached to a left surface of the motor body 72 such that a middle portion of the motor body 72 penetrates the through hole 75A. An upper end of the motor board 75 is in proximity to a lower surface of the first wall 52. A lower end of the motor board 75 is in proximity to an upper surface of the lower wall 58. The motor board 75 is positioned opposite to the right wall 55 relative to the motor 71 in the left-right direction. The first wall 52 is positioned above the motor board 75 and extends leftward from an upper end of the second wall 53 to a position beyond the motor board 75. The motor board 75 controls action of the motor body 72. A flexible cable 76 is connected to the motor board 75.

The flexible cable 76 has a generally belt shape and is connected to an right surface of an upper portion of the motor board 75. The flexible cable 76 extends upward along the right surface of the upper portion of the motor board 75 and extends leftward while passing through a space between an upper end of the motor board 75 and the first wall 52. The flexible cable 76 is exposed to the outside from the motor support 51 and extends downward. In other words, the flexible cable 76 is routed to a side opposite to the right wall 55 relative to the motor board 75. The flexible cable 76 is routed from the motor board in a direction away from the motor support 51. The flexible cable 76 is connected to a power board (not shown) to electrically interconnect the power board and the motor board 75.

The motor shaft 73 extends leftward from the middle portion of the motor body 72. The motor shaft 73 is rotatable about an axis B extending in the left-right direction, in response to the action of the motor body 72. A gear (not shown) is attached to a left end of the motor shaft 73 such that the gear and the motor shaft do not rotate relative to each other.

(5) Gear Mechanism

Figure 6:
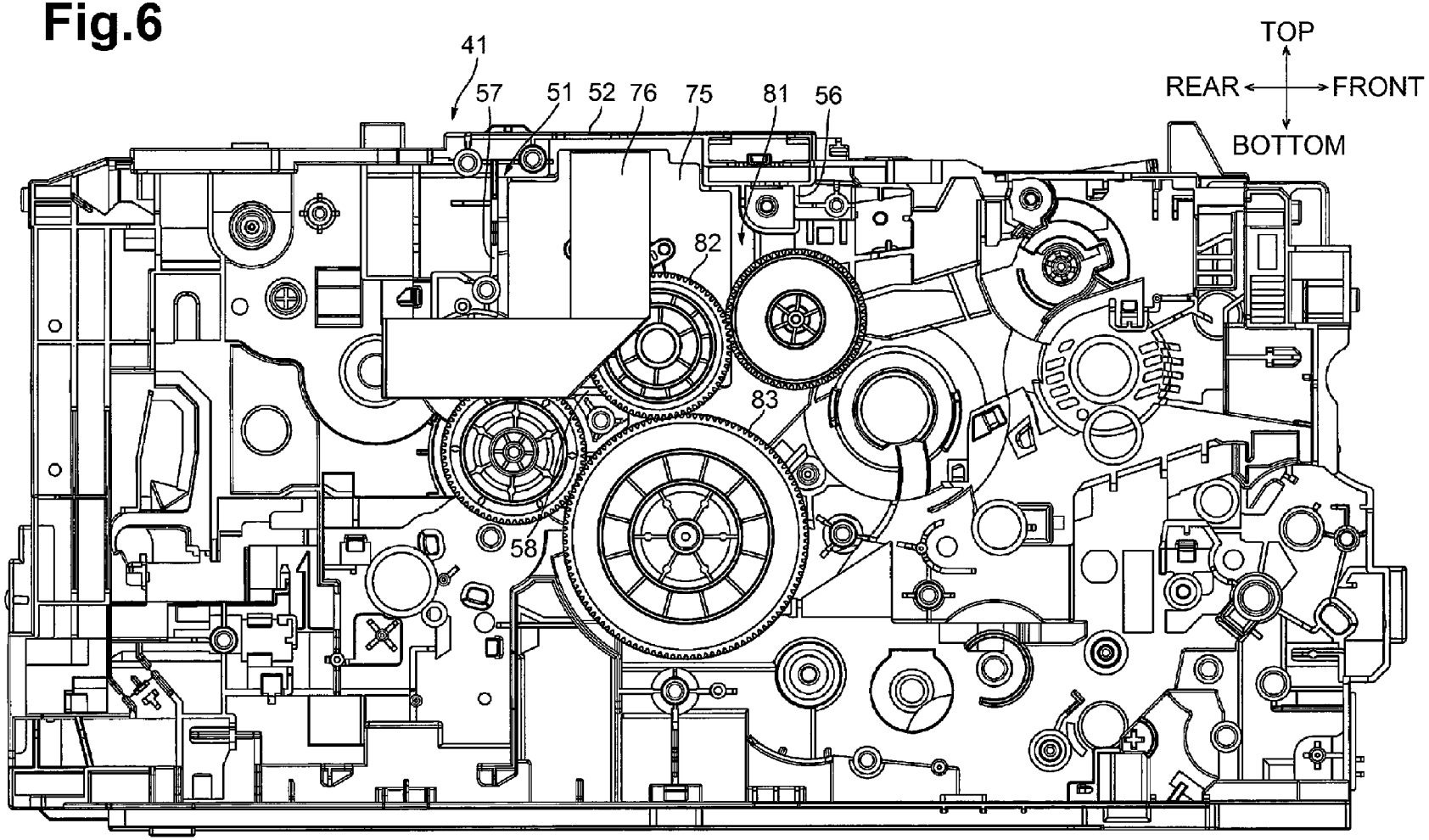
FIG. 6 is a side view of the frame of the printer shown in FIG. 1, as viewed from the left of the printer.

As shown in FIGS. 4 and 6, a gear mechanism 81 is positioned to the left of the frame 41 and at a middle portion of the frame 41 in the front-rear direction. The gear mechanism 81 includes an intermediate gear 82 and transmission gears 83.

The intermediate gear 82 is disposed at a position slightly below an upper end of the frame 41 and at a middle portion of the frame 41 in the front-rear direction. The intermediate gear 82 is supported by the frame 41 on a left surface side of the frame 41 rotatably about an axis extending in the left-right direction. An upper end portion of the intermediate gear 82 meshes with a gear of the motor shaft 73, and the intermediate gear 82 rotates in response to the rotation of the motor shaft 73.

The transmission gears 83 are positioned at a middle portion of the frame 41 vertically and in the front-rear direction. The transmission gears 83 integrally include a large-diameter gear and a small-diameter gear which is positioned to the right of the large-diameter gear and coaxial with the large-diameter gear. As shown in FIGS. 5 and 6, the large-diameter gear of the transmission gears 83 protrudes leftward through the left surface of the frame 41, and the small-diameter gear of the transmission gears 83 protrudes rightward through the right surface of the frame 41. The transmission gears 83 are supported at the frame 41 rotatably about an axis extending in the left-right direction. The transmission gears 83 are positioned below the motor support 51 and the intermediate gear 82. The large-diameter gear of the transmission gears 83 meshes with a lower end portion of the intermediate gear 82. The transmission gears rotate in response to rotation of the intermediate gear 82. As shown in FIGS. 3 and 5, the small diameter gear of the transmission gears 83 is positioned to the rear of and partially below the recessed portion 43. The small-diameter gear is configured to mesh with the drum gear 90 of the photosensitive drum 20 when the process cartridge 15 is attached into the recessed portion 43. In short, the transmission gears 83 are configured to transmit a driving force of the motor 71 to the drum gear 90 of the photosensitive drum 20. The transmission gears 83 at least partially overlap the motor 71 when the transmission gears 83 and the motor 71 are projected vertically onto a plane. In other words, the transmission gears 83 at least partially overlap the motor 71 as viewed vertically.

3. Position of Motor Support

The motor support 51 is positioned to the rear of and partially above the recessed portion 43. The motor support 51 overlaps a rear portion of the scanner unit 16 and a rear portion of the scanner support 42 in side view of the printer 1. More specifically, in side view of the printer 1, the right openings 55C overlap the rear portion of the scanner unit 16, and the intermediate openings 54A and the upper openings 52A are positioned above the scanner unit 16 and the scanner support 42. Further, in side view of the printer 1, a lower portion of the lower right portion 55B, a lower portion of the front wall 56, a lower portion of the rear wall 57, and the lower wall 58 are positioned below the scanner unit 1 and the scanner support 42.

4. Action of Motor and Exhaust Heat

The process cartridge 15 is engaged with the recessed portion 43 of the frame 41 when the process cartridge 15 is attached to the main casing 2. In this case, the drum gear 90 of the photosensitive drum 20 of the process cartridge 15 is in mesh with the small-diameter gear of the transmission gears 83. At least a portion of the motor 71 is positioned above the process cartridge 15.

When the motor body 72 is activated under control of the motor board 75, the motor shaft 73 rotates.

In response to the rotation of the motor shaft 73, the intermediate gear 82 rotates. In response to the rotation of the intermediate gear, the transmission gear 83 rotates.

In response to the rotation of the small-diameter gear of the transmission gears 83, the photosensitive drum 20 rotates. The motor 71 in operation generates heat. The heats generated from the motor 71 is discharged through the upper openings 52A of the first wall 52, the intermediate openings 54A of the upper wall 54, and right openings 55C of the right wall 55.

5. Effects of the Embodiment

In the printer 4 according to the above-described embodiment, as shown in FIG. 4, the motor support 51 is formed in the frame 41, encloses and supports the motor 71. Accordingly, the motor support 51 may prevent the user from directly touching the motor 71.

The motor support 51 has, at its upper portion, the upper openings 52A, the intermediate openings 54A, and the right openings 55C. Accordingly, the heat generated by the motor 71 may be discharged through theses openings 52A, 54A, 55C.

In the printer 1 according to the above-described embodiment, as shown in FIG. 3, the motor 71 is positioned above the process cartridge 15 which is attached to the main casing 2. This may prevent the process cartridge 15 from being affected by the heat generated by the motor 71. Consequently, the process cartridge 15 may be allowed to operate stably.

The upper openings 52A, the intermediate openings 54A, and the right openings 55C are positioned above the process cartridge 15. Consequently, the process cartridge 15 is unlikely to interfere with discharge of the heat.

In the printer 4 according to the above-described embodiment, as shown in FIG. 5, the motor support 51 has, at its upper portion, the upper openings 52A, the intermediate openings 54A, and the right openings 55. In contrast, the motor support 51 includes, at its lower portion, the lower right portion 5B, the lower portion of the front wall 56, the lower portion of the rear wall 57, and the lower wall 58. In short, the lower wall 58, the lower right portion 55B, the front wall 56, and the rear wall 57 cover a lower surface, a lower right surface, a front surface, and a rear surface of the motor 71 without any clearances. This may prevent the user from directly touching the motor 71 from a lower side of the motor support 51.

Further, in the printer 1 according to the above-described embodiment, as shown in FIG. 4, the motor 71 and the transmission gears 83 at least partially overlap each other as viewed vertically. This may prevent the printer 1 from being enlarged in the front-rear direction and in the left-right direction. Consequently, the printer 1 may be made compact.

Further, in the printer 1 according to the above-described embodiment, as shown in FIG. 4, the first wall 52 is positioned above the motor board 75. Accordingly, the first wall 52 may protect the motor board 75.

The first wall 52 has upper openings 52A. This allows the heat generated from the motor 71 to be discharged through the upper openings 52A.

Further, in the printer 1 according to the above-described embodiment, as shown in FIG. 4, the flexible cable 76 extends from the right surface of the upper portion of the motor board 75 and above the motor board 75. This allows the flexible cable 76 to be laid in a space-saving manner in the printer 1.

Because the flexible cable 76 extends in a direction away from the motor 71, the flexible cable 76 is unlikely to be affected by the heat generated by the motor 71.

Further, in the printer 1 according to the above-described embodiment, as shown in FIG. 4, the flexible cable 76 extends leftward while passing between the first wall 52 and the upper end of the motor board 75. Accordingly, the first wall 52 may protect the flexible cable 76.

Further, in the printer 1 according to the above-described embodiment, as shown in FIG. 4, the flexible cable 76 is routed to a side opposite to the right wall 55 relative to the motor board 75. This allows the flexible cable 76 to be laid in a space-saving manner in the printer 1.

Although, in the above-described embodiment, the motor support 51 has, as an example of first openings, the intermediate openings 54A and the right openings 55C, the motor support 51 may have either the intermediate openings 54A or the right openings 55C.

While the disclosure has been described in detail with reference to the specific embodiments thereof, various changes, arrangements and modifications may be applied therein without departing from the spirit and scope of the disclosure.

What is claimed is:

1. An image forming apparatus comprising:

a casing having a first end portion and a second end portion which are opposite to each other in a first direction, the casing including a frame disposed at the first end portion;

a drive source comprising a motor, the motor including a motor body configured to generate a driving force and a motor shaft configured to be rotated by the driving force;

a gear mechanism configured to receive the driving force of the drive source, the gear mechanism comprising at least one gear having a rotational axis extending in a first direction;

a drive source support which is formed in the frame and includes a first wall overlapping the motor body when viewed in the first direction and a second wall overlapping the motor body when viewed in a second direction perpendicular to the first direction, the first wall and the second wall defining a compartment that encloses and supports the drive source; and a drive board to which the drive source is attached such that the motor shaft extends from the motor body in the first direction toward the gear mechanism, wherein the gear mechanism is disposed closer to the first end portion of the casing than the drive board is to the first end portion of the casing, while the first wall and the second wall of the drive source support are disposed closer to the second end portion of the casing than the drive board is to the second end portion of the casing, and wherein at least one of the first wall and the second wall of the drive source support has a plurality of first openings, each of the first openings being spaced apart from each other and from the motor shaft, and being configured to provide air flow between an interior of the compartment and a space exterior of the compartment but within the casing of the image forming apparatus.

2. The image forming apparatus according to claim 1, further comprising a process cartridge detachably attached to the casing and supported by the frame, wherein at least a portion of the drive source is positioned above an entirety of the process cartridge in the second direction.

3. The image forming apparatus according to claim 1, wherein a lower portion of the drive source support includes a cover portion covering the drive source.

4. The image forming apparatus according to claim 2, wherein the process cartridge includes a photosensitive drum configured to carry a developing agent image thereon, and the at least one gear includes a transmission gear configured to transmit the driving force of the drive source to the photosensitive drum, the transmission gear and the drive source at least partially overlapping each other as viewed in the second direction.

5. The image forming apparatus according to claim 1, wherein the drive board is positioned opposite, in the first direction, to the first wall relative to the motor body, and wherein the frame includes a third wall positioned above the drive board and extends in the first direction, the third wall having a plurality of second openings.

6. The image forming apparatus according to claim 5, further comprising a flexible cable connected to the drive board, the flexible cable extending upward from the drive board.

7. The image forming apparatus according to claim 6, wherein the drive source support includes:

the second wall extending over the motor body;

a lower wall extending under the motor body; and the first wall extending from an end, in the first direction, of the second wall to an end, in the first direction, of the lower wall, wherein the frame includes a fourth wall extending upward from the second wall, and the third wall extends in the first direction from an upper end of the fourth wall, and wherein the flexible cable passes between the third wall and the drive board in a direction away from the drive source support.

8. The image forming apparatus according to claim 1, wherein the second wall includes corresponding ones of the first openings penetrating therethrough in the second direction, and wherein the first wall includes remaining ones of the first openings penetrating therethrough in the first direction.

9. The image forming apparatus according to claim 8, wherein the second wall of the drive source support is arcuate along a circumferential surface of the motor body.

10. The image forming apparatus according to claim 1, wherein the second wall includes the plurality of first openings, wherein an imaginary line extending through at least one of the first openings and in the second direction intersects the motor body.

11. An image forming apparatus comprising:

a casing having a first end portion and a second end portion which are opposite to each other in a first direction, the casing including a frame disposed at the first end portion;

a process cartridge detachably attached to an accommodating space in the casing and supported by the frame;

a drive source comprising a motor, the motor including a motor body configured to generate a driving force and a motor shaft configured to be rotated by the driving force;

a gear mechanism configured to receive the driving force of the drive source;

a drive source support which is formed in the frame and encloses and supports the drive source; and a drive board to which the drive source is attached such that the motor shaft extends from the motor body to the gear mechanism in the first direction away from the process cartridge, the gear mechanism being disposed closer to the first end portion of the casing than the drive board is to the first end portion of the casing, wherein at least a portion of the drive source is positioned above an entirety of the process cartridge in a second direction perpendicular to the first direction, and wherein the drive source support has a wall facing the at least a portion of the drive source and having a plurality of openings which are spaced from each other, the wall being disposed closer to the second end portion of the casing than the drive board is to the second end portion of the casing.

12. The image forming apparatus according to claim 1, further comprising a process cartridge detchably attached to an accommodating space in the casing and supported by the frame, wherein the drive source support includes a lower wall extending under the motor body and partially defining the accommodating space.

13. The image forming apparatus according to claim 11, wherein the drive source support includes a lower wall extending under the motor body and partially defining the accommodating space.

* * * * *